United States Patent [19]

Komiya et al.

[11] 4,348,469

[45] Sep. 7, 1982

[54] PHOTO-SENSITIVE MEDIUM FOR ELECTROPHOTOGRAPHY

[75] Inventors: Takao Komiya, Yokohama; Mitsuo Minomiya, Tokyo both of Japan

[73] Assignee: Canon Kabushiki Kaisha, Tokyo, Japan

[21] Appl. No.: 224,801

[22] Filed: Jan. 13, 1981

Related U.S. Application Data

[63] Continuation of Ser. No. 882,632, Mar. 2, 1978, abandoned, which is a continuation of Ser. No. 675,619, Apr. 9, 1976, abandoned, which is a continuation of Ser. No. 605,468, Aug. 18, 1975, abandoned, which is a continuation of Ser. No. 366,352, Jun. 4, 1973, abandoned.

[30] Foreign Application Priority Data

Jun. 12, 1972 [JP] Japan ..... 47-58330

[51] Int. Cl.[3] ..... G03G 5/14; G03G 13/10

[52] U.S. Cl. ..... 430/55; 430/117; 430/132; 430/85; 430/66

[58] Field of Search ..... 430/66, 67, 117, 132, 430/94, 84, 85, 55

[56] References Cited

U.S. PATENT DOCUMENTS

| | | | |
|---|---|---|---|
| 2,860,048 | 11/1958 | Deubner | 430/67 |
| 3,092,493 | 6/1963 | Kaiser | 430/67 |
| 3,434,832 | 3/1969 | Joseph et al. | 430/67 |

*Primary Examiner*—Richard L. Schilling
*Assistant Examiner*—John L. Goodrow
*Attorney, Agent, or Firm*—Fitzpatrick, Cella, Harper & Scinto

[57] ABSTRACT

A photosensitive medium for electrophotography comprises an electricaly conductive or a dielectric substrate, a photoconductive layer overlying the substrate, and a transparent dielectric layer overlying the photoconductive layer. The substrate has the entire peripheral portion thereof formed to provide a region uncovered by the photoconductive layer. The transparent dielectric layer is resistant to liquid developer used in electrophotography and may cover the photoconductive layer and the uncovered region of the substrate. Alternatively, the transparent dielectric layer may be secured to the photoconductive layer and the uncovered region of the substrate by the use of an adhesive which is also resistant to the liquid developer.

12 Claims, 6 Drawing Figures

PHOTO-SENSITIVE MEDIUM FOR ELECTROPHOTOGRAPHY

This is a continuation of application Ser. No. 882,632, filed Mar. 2, 1978, now abandoned; which in turn was a continuation of application Ser. No. 675,619, filed Apr. 9, 1976, now abandoned; which in turn was a continuation of application Ser. No. 605,468, filed Aug. 18, 1975 now abandoned; which in turn was a continuation of application Ser. No. 366,352, filed June 4, 1973, now abandoned.

BACKGROUND OF THE INVENTION

1. Field of the Invention

This invention relates to a photosensitive medium usable with the wet electrophotographic system and having a photoconductive layer resistant to liquid developer. Generally, the configuration of the photosensitive medium for electrophotography is determined by the type of electrophotography with which it is used. The electrophotographic system may generally be classified into two types, one of which provides electric charge directly on the photoconductive layer and the other type provides electric charge on a dielectric layer formed on the photoconductive layer. The latter system is more advantageous in respect of the characteristic of the photosensitive medium itself and the higher electrostatic contrast provided to form a clear copy image. The photosensitive medium of the present invention is directed for use with the said latter type of system.

2. Description of the Prior Art

The electrophotographic system of the described type using such photosensitive medium has been proposed, for example, by Japanese Pat. No. 23910/1967 and Japanese Pat. No. 21748/1968, each of which discloses a method comprising the steps of charging a photosensitive medium through corona discharge in light or dark regions to thereby cause the charge to be trapped in the vicinity of the interface between the photoconductive layer and the transparent dielectric layer of the photosensitive medium, thereafter projecting image light upon the photosensitive medium while applying a charge of the opposite polarity or AC corona discharge thereto to reverse or erase the charge in the light regions of the photosensitive layer by the utilization of the impedance difference between the light and dark regions of the photoconductive layer, thereby forming a latent image having a contrast of electrostatic potential, then developing and transferring such latent image through conventional processes to provide a copy image.

In the past, the photosensitive medium has been used with the dry development to form images, but if used with the wet development, it would probably bring about various advantages such as speed-up of the development and hence of the copying, improved definition of the resultant images due to the fine toner particles, simplified construction of the developing device and accordingly reduced cost of the copying apparatus. Nevertheless, this has not been put into practice mostly for the reason that the characteristic of the photoconductive layer is deteriorated by the dispersion liquid contained in the liquid developer. For example, in case of a photosensitive medium having a photoconductive layer formed of non-crystalline Se or Se-Te alloy, the cross-sectional portion of such photoconductive layer which is exposed may be affected by its contact with the dispersion liquid in the liquid developer, such as kerosene, silicone oil, carbon tetrachloride or the like, or a mixture thereof of various organic solvents slightly present therein, so that crystallization will gradually progress in the photoconductive layer until its photoconductivity is entirely lost. This is particularly so in the copying machines or the like where both the photosensitive medium and the developing liquid often experience the temperatures of 40° to 50° C.

Also, in case of a photosensitive medium whose photoconductive layer is formed of photoconductive fine particles dispersed in a resin, the formation of such photoconductive layer is done by applying and drying a paint of photoconductive material and resin binder: in the process of drying the solvent, the photoconductive layer unavoidably becomes porous since it is desirable to reduce the percentage of the binder resin in the photoconductive layer as much as possible in order to enhance the sensitivity of the layer. Thus, the dispersion liquid contained in the developer would generally intrude into the photoconductive layer through the cross-section thereof to thereby reduce the resistance of the photoconductive layer to the dark, which in turn leads to an insufficient potential in the dark regions of a copy image and accordingly to a lower contrast of the final copy image. Especially, when organic solvents are present mixed in the dispersion liquid, the binder resin would dissolve to destroy the photoconductive layer and the effluent binder resin would variously affect the developing liquid.

This is also the case with a photoconductive layer which comprises a coating of polyvinyl carbazole and other various organic photoconductive materials or a coating of organic photoconductive material and resin.

SUMMARY OF THE INVENTION

The present invention intends to provide a photosensitive medium for electrophotography which has advantageously overcome the above-noted drawbacks of the conventional three-layer photosensitive medium and which is particularly usable with the wet developing system.

According to a feature of the present invention, the photosensitive medium for electrophotography comprises three layers like the conventional one but is characterized in that a region free of a photoconductive layer is provided on a substrate along the entire peripheral portion thereof and that a transparent dielectric layer resistant to the dispersion liquid in the electrophotographic liquid developer is overlaid to cover both the photoconductive layer and the peripheral portion of the substrate without leaving the photoconductive layer exposed. Thus, when the photosensitive medium is bathed in the liquid developer, the photoconductive layer may be completely isolated from the dispersion liquid without being varied in any way, to thereby permit the photosensitive medium to stand semipermanently repeated use.

According to another feature of the present invention, the photosensitive medium for electrophotography is characterized in that a transparent dielectric film resistant to the dispersion liquid in the electrophotographic liquid developer is joined to the photoconductive layer and the peripheral portion of the substrate by means of an adhesive which is also resistant to said dispersion liquid. This construction also ensures the photoconductive layer to be completely isolated from the dispersion liquid and permits semipermanently repetitive use of the photosensitive medium.

BRIEF DESCRIPTION OF THE DRAWINGS

The invention will become more fully apparent from the following detailed description taken in conjunction with the accompanying drawings, in which.

DESCRIPTION OF THE PREFERRED EMBODIMENTS

Figure 1:
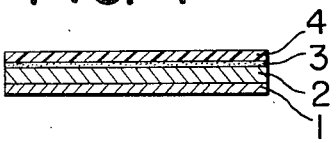
FIG. 1 is a cross-sectional view of a photosensitive medium for the conventional dry electrophotography.

The conventional photosensitive medium as shown in FIG. 1, is comprised of a substrate 1, a photoconductive layer 2 overlaid on an entire surface of the substrate, and a transparent dielectric layer directly formed over the photoconductive layer or a transparent dielectric film 4 bonded to the photoconductive layer by means of an adhesive layer 3.

Figure 2:
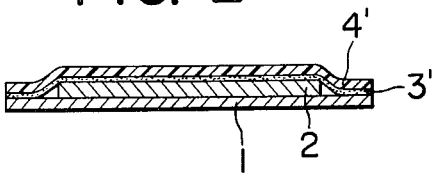
FIG. 2 is a cross-sectional view of the photosensitive medium for wet electrophotography according to an embodiment of the present invention.
Figure 3:
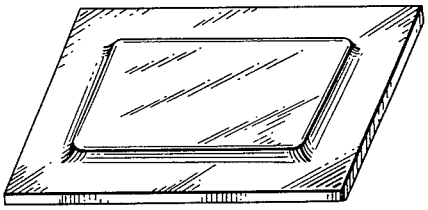
FIG. 3 is a perspective view of the photosensitive medium shown in FIG. 2.
Figure 6:
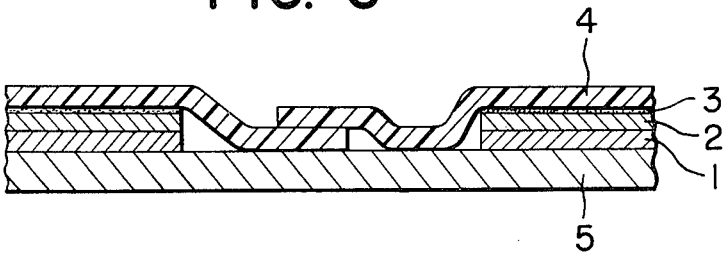
FIG. 6 is a cross-sectional view of another embodiment of the present invention.

In contrast, the photosensitive medium for electrophotography according to the present invention may comprise, as shown in FIG. 2, a substrate 1, a photoconductive layer 2 overlaid on one surface of the substrate leaving the peripheral portion of the substrate uncovered by the photoconductive layer, and a transparent dielectric layer 4' resistant to electrophotographic developing liquid and formed directly to cover the layer 2 and the peripheral portion of the substrate 1, or a transparent dielectric film 4' resistant to said developing liquid and bonded to the layer 2 and the peripheral portion of the substrate by means of an adhesive 3' which is also resistant to the electrophotographic developing liquid. Such photosensitive medium of the present invention is pictorially shown in FIG. 3.

Figure 4:
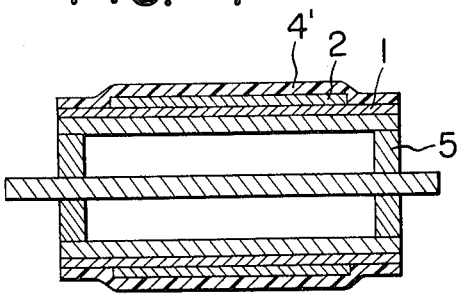
FIG. 4 is a cross-sectional view of another form of the photosensitive medium according to the present invention.
Figure 5:
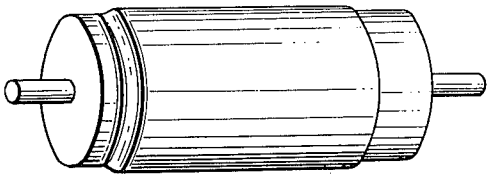
FIG. 5 is a perspective view of the photosensitive medium shown in FIG. 4.

The photosensitive medium according to the present invention may of course be configured in any desired shape depending on the intended usage thereof, and is not restricted to the shown flat form but may take a cylindrical configuration as shown in FIGS. 4 and 5.

As seen in FIG. 4, a substrate 1 may be provided over the outer surface of a cylinder 3 and a photoconductive layer 2 may then be provided on the substrate 1 except the opposite end portions thereof, whereafter a transparent dielectric layer 4' resistant to the electrophotographic developing liquid may be formed to cover both the photoconductive layer 2 and the opposite end portions of the substrate 1, or alternatively a transparent dielectric film 4' resistant to said developing liquid may be bonded to the photoconductive layer 2 and the end portions of the substrate by means of an adhesive resistant to the developing liquid, as in the case of the above-described flatshaped photosensitive medium. The resultant photosensitive medium prevents the appearance as shown in FIG. 5.

The term "resistant" to the electrophotographic developing liquid means that the material is not soluble, swollen or decomposed by the developing liquid. The adhesive usable in the photosensitive medium of the present invention may be any one of nitrile rubber, acrylic resin, epoxy resin, polyester resin, polyurethane resin and the like. The material usable as the transparent dielectric layer may most preferably be a thermosetting resin such as melamine resin, acrylic resin, aminoalkyd resin, epoxy resin, polyester resin, polyurethane resin or the like, or any other resin which is resistant to the developing liquid. The transparent dielectric film may be formed of one of various plastic films, and preferably of polyester film which is excellent in mechanical strength.

The photoconductive layer in the photosensitive medium of the present invention may be formed of Se or Se-Te alloy, or a photoconductive material dispersed in a resin. In the latter case, the photoconductive material may be one of various materials such as ZnO, CdS, CdSe, etc., of which CdS is most preferable because of its higher photosensitivity. Alternatively, one of various photoconductive materials may be used with or without a binder.

Some examples of the present invention will be shown below.

EXAMPLE 1

1,000 grams of photoconductive CdS, 500 grams of lacquer chiefly composed of vinylchloride-vinylacetate copolymer resin (including 20% of solid content), and about 150 cc of thinner chiefly composed of methyl isobutylketone were mixed together, and then fully blended by means of a three-roll mill to provide a paint of photoconductive material with resin dispersed therein. A polyester tape having a thickness of 150 microns and a width of about 20 mm was attached to the peripheral portion of a flat aluminum sheet having a thickness of 2 mm, whereafter said paint was uniformly spread over the aluminum sheet by means of a metallic blade to form a layer exactly equal in thickness to the tape. Then, the formed layer was dried and thereafter, the tape was removed. As the result, a photoconductive layer as thick as about 50 microns was formed on the aluminum sheet except the peripheral portion thereof having a width of about 20 mm. A mixed solution of polyurethane resin adhesive EPS 623 and appropriate curing agent KN-40 (both being the trade names of the products of Dainippon Ink Kagaku Kogyo K.K.) was applied to a polyester film of 23-micron thickness by means of a wire bar so as to provide a thickness of about 10 microns when dried. After drying, it was secured to the photoconductive layer on the aluminum sheet and the exposed peripheral portion of the aluminum sheet by means of a rubber roller, and thus a complete photosensitive medium was produced. Such photosensitive medium was subjected to the electrophotographic metl. d as shown in aforementioned Japanese Pat. Nos. 23910/1967 and 24748/1968, thereby forming an electrostatic latent image thereon. Thereafter, the latent image was developed by means of an electrophotographic developing liquid using a dispersion liquid chiefly composed of kerosene. The developed image was transferred to a transfer medium, thereby providing a clear copy image. The photosensitive medium could be substantially semi-permanently used by repetitively bathing it in said developing liquid without any variation occurring to the properties of the transparent dielectric layer as well as the adhesive layer.

EXAMPLE 2

Instead of the binder resin employed in Example 1, epoxy resin lacquer "FASTIGHT" (trade name of the product of Ohashi Kagaku Kogyo K.K. and including 30% of solid content was used with 400 grams of an appropriate curing agent and an appropriate thinner to thereby provide a paint, which was likewise applied to an aluminum sheet and then dried. Thereafter, it was left at room temperature for four days for setting, thus forming a photoconductive layer. The aluminum sheet again had a peripheral portion of about 20 mm in width formed free of the photoconductive layer. Epoxy resin clear lacquer "MILLION No. 1-A" (trade name of the product of Kansai Paint Co., Ltd.) and an appropriate curing agent were uniformly applied through the use of a spray gun so as to provide a thickness of about 30 microns when dried. After drying the coating was heated for setting at 100° C. for 30 minutes, thereby producing a transparent dielectric layer and accordingly a complete photosensitive medium. Again, this photosensitive medium provided equally good copy images and was excellently resistant to the electrophotographic developing liquid to permit frequent use during a long time.

EXAMPLE 3

Instead of the photoconductive layer employed in Example 1, use may be made of a photoconductive layer formed by sufficiently mixing 30 grams of polyvinyl carbazole, 13 grams of diphenyl chloride "KANECHLOR" (trade name of the product of Kanebuchi Kagaku Kogyo K.K.) and 400 milliliters of benzene and 30 cc of a solution composed of 300 grams of crystal violet dissolved in 100 milliliters of chloroform and applying such a liquidous mixture so as to provide a thickness of 20 to 30 microns when dried. The result was the same as described above.

EXAMPLE 4

Aluminum foil of 30 microns thickness and polyester film of 25 microns thickness were laminated one upon the other by the use of adhesive EPS-623 and KN-40 similar to these employed in Example 1. The lamination was placed on a flat stationary plate with the film surface overlying. According to the method of Example 1, a photoconductive layer and a region free of such photoconductive layer were provided and a transparent dielectric layer was formed thereon, thus providing a photosensitive medium. This was wrapped about a cylinder of aluminum and secured thereto by means of said adhesive, thus providing a final photosensitive medium having the dielectric layer as the substrate.

Such photosensitive medium was used with the automatic electrophotographic copying machine as described in Example 1. The result was good.

EXAMPLE 5

Se was uniformly deposited to a thickness of about 30 microns on the outer surface of an aluminum cylinder by vacuum evaporation to thereby form a photoconductive layer. Thereafter, the portions of the photoconductive layer of Se which cover the opposite end portions of the cylinder were successively dipped in a liquid of carbon disulfide to dissolve and remove the photoconductive material in these portions each as wide as about 20 mm, thereby forming the portions free of photoconductive layer. Over the entire surface of such cylinder, polyester resin clear Lacquer "POLYBEST-CLEAR" (trade name of the product of Dainippon Paint Co., Ltd.) mixed with an appropriate curing agent was applied through a spray gun so as to provide a thickness of about 30 microns when dried. The coating was left for five hours for drying and setting, thus forming a transparent dielectric layer and accordingly a complete photosensitive medium.

The photosensitive medium was mounted in an appropriate electrophotographic copying machine, whereafter formation of a latent image, development and transfer thereof was automatically carried out according to the same processes as described in Example 1, resulting in a good copy image again. The photosensitive medium proved sufficiently resistant to the developing liquid and stood long-time repetitive use without the crystallization of the photoconductive layer being expedited.

EXAMPLE 6

Instead of the adhesive employed in Examples 1 and 3 to join the transparent dielectric film, acrylic resin adhesive "DB DOXD 9A04" (trade name of the product of Diabond Kogyo K.K.) was used to obtain the same results as described.

EXAMPLE 7

The adhesive solution employed in Examples 1 and 3 to join the transparent dielectric film was replaced by a solution of 100 parts of epoxy resin adhesive "EPIKOTE 154" (trade name of the product of Shell Oil Co., Ltd.) and 20 parts of curing agent "ACMEX 1192" (trade name of the product of Nippon Gosei Kake K.K.) dissolved in a suitable amount of methylethyl ketone. The result was good again.

EXAMPLE 8

Instead of the adhesive employed in Examples 1 and 3, use was made of nitrile rubber adhesive "DOXD G-103" (Konishi Gisuke Co., Ltd.) to obtain the same results as described above.

As has been described above, the present invention provides a photosensitive medium for wet electrophotography which permits the liquid developing process capable of providing excellent electrophotographic images to be used with the image transfer type electrophotography, and which eliminates the use of special sensitive paper and may simply use ordinary paper to provide clear copy images. Thus the present invention is highly effective in that it provides copies of good quality which will even change the conventional concept of copy.

We claim:

1. A process for developing an electrostatic image with a liquid developer on a photosensitive medium resistant to the deteriorating effects of the liquid developer, said process comprising the steps of applying an electrostatic charge of a first polarity to said photosensitive medium, imagewise exposing the resulting photosensitive medium while applying a charge of the opposite polarity to said first polarity or AC corona discharge thereto to an electric field capable of eliminating the electrostatic charge of said first polarity from the exposed area of said photosensitive medium to thereby form a latent electrostatic image on said photosensitive medium, and then treating said photosensitive medium with a liquid developer to develop the latent image, said photosensitive medium including:

an electrically conductive or dielectric substrate;

a photoconductive layer positioned on a portion of a surface of said substrate, wherein said layer does not extend along the peripheral portions of said substrate;

an adhesive layer positioned on said photoconductive layer and said peripheral margin of said substrate, said adhesive layer being resistant to the liquid developer; and a transparent, dielectric resinous layer resistant to the liquid developer and capable of retaining an electrostatic charge, said dielectric layer having a thickness greater than about 25 microns and covering said photoconductive layer and extending around the entire periphery of the layer to thereby fully enclose said photoconductive layer and cover at least part of the peripheral portions of the substrate, said adhesive layer preventing separation of said dielectric layer from said photoconductive layer and said peripheral margin of said substrate.

2. A process according to claim 1, wherein said dielectric layer is a thermosetting resin selected from the group consisting of melamine, acrylic, aminoalkyd, epoxy, polyester and polyurethane resins.

3. A process according to claim 1, wherein said adhesive is selected from the group consisting of nitrile, rubber, acrylic resin, epoxy resin, polyester resin and polyurethane resins.

4. A process according to claim 1, wherein said photoconductive layer is composed of Se or a Se-Te alloy.

5. A process according to claim 1, wherein said photoconductive layer is composed of inorganic photoconductive material dispersed in a resin binder.

6. A process according to claim 1, wherein said dielectric resinous layer is formed by attaching a resinous film.

7. A process according to claim 1, wherein said dielectric resinous layer is formed by coating a resin.

8. A photosensitive medium for use in an electrophotographic process, which process comprises the steps of applying an electrostatic charge of a first polarity to the photosensitive medium, imagewise exposing the resulting photosensitive medium while applying a charge of the opposite polarity to said first polarity or AC corona discharge thereto to form a latent electrostatic image on said photosensitive medium and developing said latent image with a liquid developer, said photosensitive medium comprising:

an electrically conductive or dielectric substrate;

a photoconductive layer positioned on a portion of a surface of said substrate so as to leave a peripheral margin of said substrate uncovered by said photoconductive layer;

an adhesive layer positioned on said photoconductive layer and said peripheral margin of said substrate, said adhesive layer being resistant to the liquid developer; and a transparent dielectric resinous layer on said photoconductive layer, said dielectric layer being composed of a material which is resistant to said liquid developer, said dielectric layer covering said entire photoconductive layer and at least a portion of said peripheral margin of said substrate, and said transparent dielectric layer having a thickness greater than about 25 microns and being capable of retaining electrostatic charge, said adhesive layer preventing separation of said dielectric layer from said photoconductive layer and said peripheral margin of said substrate.

9. The photosensitive medium of claim 8, wherein said photoconductive layer is composed of Se or Se-Te alloy.

10. The photosensitive medium of claim 8, wherein said photoconductive layer is composed of inorganic photoconductive material dispersed in a resin binder.

11. The photosensitive medium of claim 8, wherein said dielectric resinous layer is formed by coating a resin.

12. The photosensitive medium of claim 8, wherein said dielectric resinous layer is formed by coating a resin.

* * * * *

UNITED STATES PATENT AND TRADEMARK OFFICE

CERTIFICATE OF CORRECTION

PATENT NO. : 4,348,469

DATED : September 7, 1982

INVENTOR(S) : TAKAO KOMIYA, ET AL.

It is certified that error appears in the above-identified patent and that said Letters Patent is hereby corrected as shown below:

Column 1, line 36, "21748/1968" should read --24748/1968--.

Column 3, line 53, "3" should read --5--.

Column 4, line 49, "23-" should read --25- --;
line 56, "metl." should read --method--;
line 57, delete "d"; after "Pat." insert --Publications--.

Column 5, line 6, "30%" should read --50%--;
line 34, "30" should read --50--;
line 44, "these" should read --those--;
line 66, "these" should read --those--.

UNITED STATES PATENT AND TRADEMARK OFFICE

CERTIFICATE OF CORRECTION

PATENT NO. : 4,348,469

DATED : September 7, 1982

INVENTOR(S) : TAKAO KOMIYA, ET AL.

It is certified that error appears in the above-identified patent and that said Letters Patent is hereby corrected as shown below:

Column 6, line 1, "Laquer" should read --lacquer--;
line 23, "DOXD" should read --BOND--;
line 32, "1192" should read --H92--;
line 33, "Kake" should read --Kako--;
line 39, "DOXD" should read --BOND--;
line 40, after "Gisuke" insert --&--.

Signed and Sealed this

*Eighth* Day of *February 1983*

[SEAL]

*Attest:*

GERALD J. MOSSINGHOFF

*Attesting Officer*

*Commissioner of Patents and Trademarks*